United States Patent [19]

Van Valkenburg

[11] 4,389,827

[45] Jun. 28, 1983

[54] THROUGH-THE-WALL AIR CONDITIONER COVER KIT

[76] Inventor: Constance M. Van Valkenburg, 494 Curfew St., St. Paul, Minn. 55104

[21] Appl. No.: 157,800

[22] Filed: Jun. 9, 1980

[51] Int. Cl.[3] ..... E06B 7/00; E06B 9/00

[52] U.S. Cl. ..... 52/511; 52/202; 52/309.4; 49/465; 98/94 AC

[58] Field of Search ..... 52/202, 403, 309.4, 52/27, 511; 98/94 AC; 206/523; 150/52 R; 160/352

[56] References Cited

U.S. PATENT DOCUMENTS

| | | | |
|---|---|---|---|
| 3,002,236 | 10/1961 | Humphner | 52/202 |
| 3,251,460 | 5/1966 | Edmonds | 206/523 |
| 3,328,929 | 7/1961 | Mullins | 52/202 |
| 3,388,520 | 6/1968 | Perry | 52/202 |
| 3,427,776 | 2/1969 | Lake | 52/403 |
| 3,436,889 | 4/1969 | Jessee | 52/202 |
| 4,068,428 | 1/1978 | Peterson | 52/202 |
| 4,106,399 | 8/1978 | Lawrence | 98/116 |
| 4,204,373 | 5/1980 | Davidson | 52/127 |
| 4,272,934 | 6/1981 | Cowden | 52/202 |

*Primary Examiner*—John E. Murtagh

*Attorney, Agent, or Firm*—J. Wade Van Valkenburg

[57] ABSTRACT

A kit for preventing heat loss and covering a through-the-wall air conditioner unit comprising a rigid foamed polymeric cover piece and an attachment means comprising a backing having a layer of pressure sensitive adhesive on one side and a sealing means on the opposite side.

2 Claims, 5 Drawing Figures

THROUGH-THE-WALL AIR CONDITIONER COVER KIT

BACKGROUND OF THE INVENTION

1. Field of the Invention

This invention relates to a kit for removably sealing and insulating through-the-wall air conditioners with closure to or against the wall.

2. Description of the Prior Art

The escalating cost of petroleum and petroleum products has caused increased attention to the conservation of energy. One serious site where energy is lost is through and around air conditioners that are placed in sleeves through the walls of buildings. Heat loss is not only by conduction and convection through metal parts but also accrues due to open ports which permit cold drafts egress to the building. Present commercially-available covers for through-the-wall air conditioners consist of either poorly insulating polyolefin covers or expensive custom made covers of metal or wood unlined or lined with rigid plastic.

It has long been recognized that windows and air conditioners represent significant conduits for heat loss from heated buildings. For example, U.S. Pat. No. 3,002,236, (Humphner) teaches a closure of molded transparent polystyrene which is custom made for attachment to a window and an air conditioner unit which remains in the window while not in use; U.S. Pat. No. 3,328,989 (Mullins) discloses a rigid combination storm window and air conditioner cover that is attached by hinges and clips to form fit over a window containing an air conditioner unit. U.S. Pat. No. 3,388,520 (Perry) discloses a cover for the front opening of a window air conditioner in which the cover is attached by spring clips. U.S. Pat. No. 3,436,889 (Jessee) describes an air conditioner cover assembly consisting of a polystyrene frame and decorator panels inserted therein. The aforementioned patents teach means for covering window air conditioners thereby requiring wholly or in part, transparency, specific construction for a particular air conditioner model or custom manufacture for a specific window.

Only a limited number of attachment means have been proposed for use for the attachment of covers to air conditioners. There, however, have been a variety of fastening means for fastening storm windows to windows. For example, in U.S. Pat. No. 2,514,316 (Dobrin) there is described the use of an adhesive seal to fasten a translucent material to the sash; in U.S. Pat. No. 3,251,399 (Grossman) a "Velcro" fastener is stitched or adhesively bonded to a panel; in U.S. Pat. No. 4,068,428 (Peterson) "hook and loop" fastening elements adhered directly to the plastic sheets are used for fastening to an insulating window; and finally, in U.S. Pat. No. 4,079,772 (Klaenhammer and Adams) magnetic strips are used to fasten a flexible window shade to a frame.

SUMMARY OF THE INVENTION

In the present invention a rigid plastic cover is manufactured from foaming-in-place styrene beads. Partially expanded styrene beads are placed in a mold and expanded by steam to form the rigid expanded polystyrene insulating cover. One cover size is approximately 67 cm×42 cm. in internal dimensions. These dimensions are slightly larger than a preponderance of sleeves in which the through-the-wall air conditioners are mounted. This invention, then, is a kit which consists of the cover piece, which may be applied inside or outside the building, and a variety of adhesively backed attachment means. The kit user, in placing the cover piece over the air conditioner, uses as much or as little attachment means as are necessary to give a rigid, tight, draft free fit of the cover piece to the air conditioner and proximal wall. The attachment means are all adhesively backed and may or may not have a low adhesion back sizing layer over the adhesive to protect said adhesive. The attachment means is usually adhesively bonded by the user to the expanded styrene cover. The attachment means is comprised of, in the alternative, (1) an adhesively backed (on one side) flexible plastic foam 0.3 to 2.5 cm. thick; (2) adhesively backed Velcro tape (hook and loop fastener); (3) an adhesively backed flexible rubber based magnet such as Plastiform manufactured by the Minnesota Mining and Manufacturing Co.; or (4) a double stick plastic foam tape with adhesive on each side (a release liner is affixed to one side to facilitate unrolling of the tape).

BRIEF DESCRIPTION OF THE DRAWING

In the accompanying diagrammatic drawings which illustrate the invention.

DESCRIPTION OF THE PREFERRED EMBODIMENT

Figure 1:
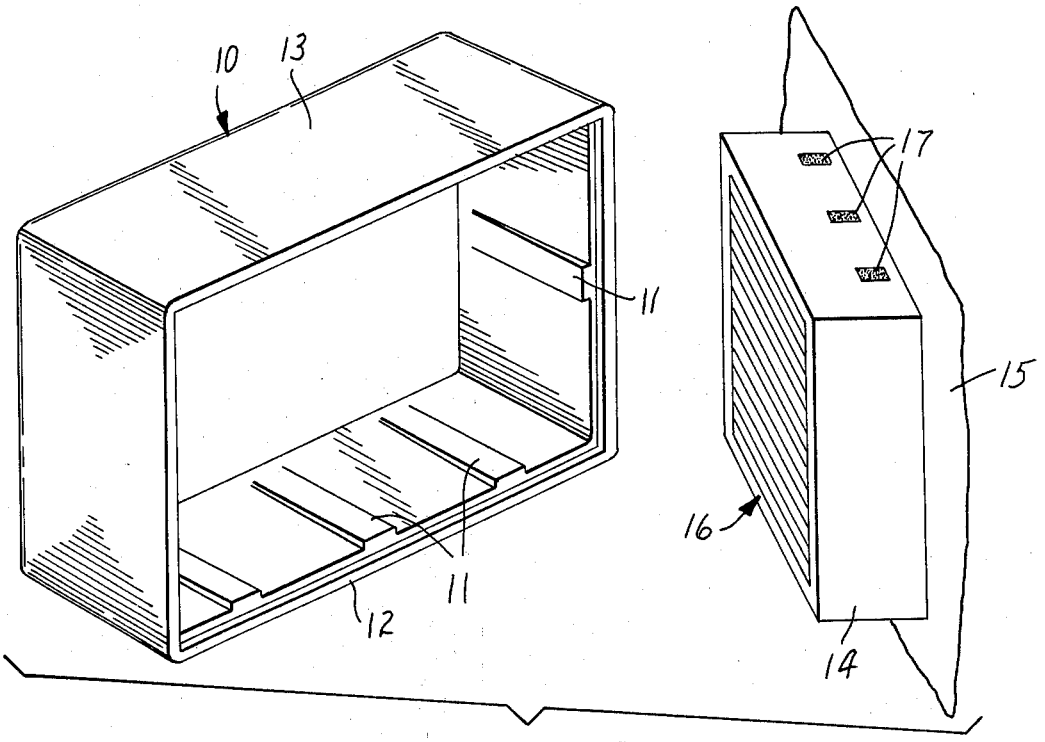
FIG. 1 shows in prospective views, prior to attachment, the cover piece from the open side, and the placement of adhesively backed loops or fasteners on top of the sleeve for through-the-wall air conditioners.
Figure 2:
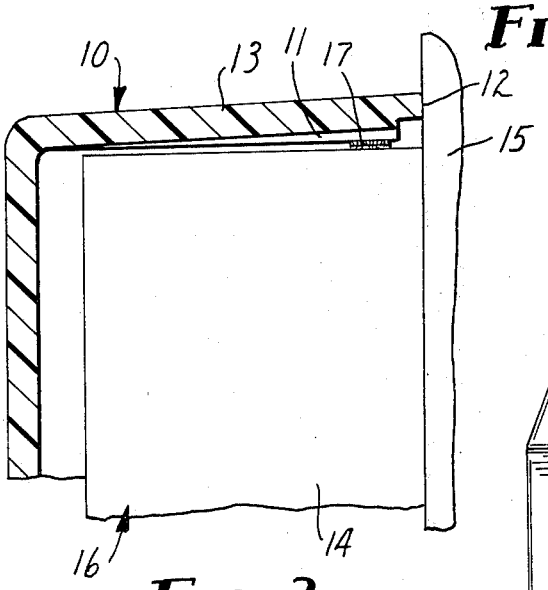
FIG. 2 is a partial sectional view of the apparatus of FIG. 1 with the cover piece attached by means of hook and loop fasteners to the sleeve or housing of the air conditioner.

FIGS. 1 and 2 disclose a rigid foamed styrene cover comprising base wall and four upstanding side walls defining a chamber having an open end. The volume of the chamber is greater than the volume of the portion of the air conditioner unit to be covered. In the embodiment illustrated ribs 11 are formed on the inside of all four side walls. The leading edge 12 around the open end of the chamber is notched to the inside to allow for a peripheral frame around the air conditioner. The knotch allows the leading edge 12 to fit tightly against the wall of the building and allows a foam tape (described below) to be recessed therein, if desired. In the cover piece 10, the side walls are tapered in from the open end to the base wall at an angle of inclination of approximately ten degrees. The ribs 11 are not tapered but are on a perpendicular plane with the wall of the building. The housing (sleeve) 14 for an air conditioner 16 is mounted in the wall 15 of a building. Adhesively attached to the top of the housing 14 are three "Velcro" tabs 17. Either the hook or the loop tab is adhesively attached to housing 14 and the complementary portion of the "Velcro" tab is correspondingly adhesively mounted on the ribs 11 of the cover piece 10.

FIG. 2 shows in a cut-away cross section the cover piece 10, tapered side walls 13, ribs 11 and mated "Velcro" tabs adhesively bonded to the rigid expanded styrene housing 14 that encompasses the air conditioner that goes through-the-wall 15 of a building.

The tabs 17 of FIG. 1 may be, in the alternative, small strips of flexible rubber based magnetic strips (Plastiform from the Minnesota Mining and Manufacturing Co.) that are adhesively backed. When tabs 17 are magnetic strips the magnetic side adheres to the housing 14 and the adhesive side is free to bond to ribs 11 when the cover is placed over the air conditioner as shown in FIG. 2.

Figure 3:
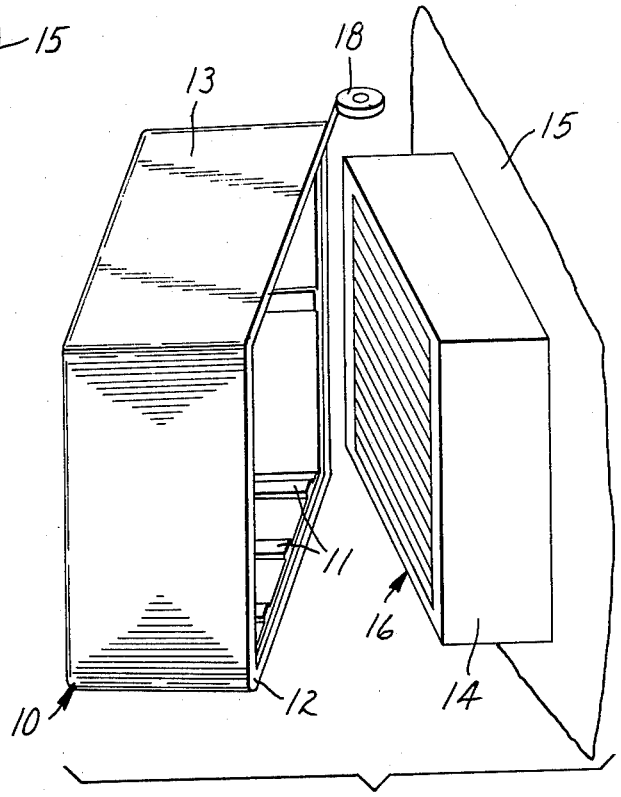
FIG. 3 is a prospective view showing the application of a double stick tape fastening means to the cover's edge to enable the cover to fasten to the proximal wall on an inside the room application.

FIG. 3 illustrates the placement of double stick 0.8 mm. polyethylene foam mounting tape (Mounting tape P-3200; a closed cell, cross-linked, polyethylene foam coated on both sides with high tack pressure sensitive adhesive, has exceptional high dead load weight qualities; available from the Northern-Foam-Inc. of Minneapolis, Minn.). The double stick tape, which may vary in width from 0.8 mm. to 3 mm., is being applied in FIG. 3 to the lead edge 12 of cover piece 10 from a roll of said double stick tape 18. The facing of the double stick tape is placed in such a manner that the cover with double stick tape 18 adhered thereto will come in direct contact with wall 15, and a slight application of pressure to the cover piece 10 will cause the cover piece to adhere rigidly to the wall 15. Since the adhesional forces of this system are only moderate, this system is best adapted for application of the cover piece to internal walls.

Figure 4:
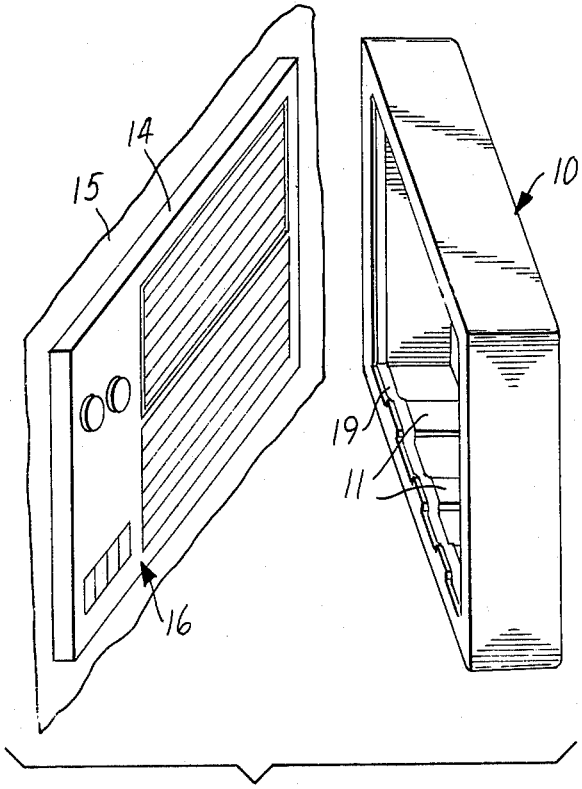
FIG. 4 is a prospective view showing a cover after application of an adhesively backed foam effectively reducing the inside dimensions at the opening of the cover piece.

FIG. 4 depicts a system for application of the cover piece to the portion of air conditioner 16 protruding toward the inside portion of a building. This system is adaptable to internal or external applications, but when applied internally the upstanding side walls are of smaller dimensions. A layer of adhesively backed urethane, polyvinyl chloride or polyethylene flexible foam tape 19 (Northern-Foam-Inc., Minneapolis, Minn.) from 0.5 to 1 cm. in thickness is applied to the inside front (open end) of the cover piece 10. This foam effectively reduces the internal opening of the cover piece. This foam may be placed on one, two, three or four of the upstanding walls of cover piece 10, or alternatively, in small pieces on one or more of the ribs 11. One uses just the amount of foam tape to affect a firm frictional fit of the cover piece 10 around the housing 14 of air conditioner 16. Sufficient flexible foam tape is applied to piece to the housing and firmly up against the wall 15, thereby affecting a draft proof seal around the air conditioner.

Figure 5:
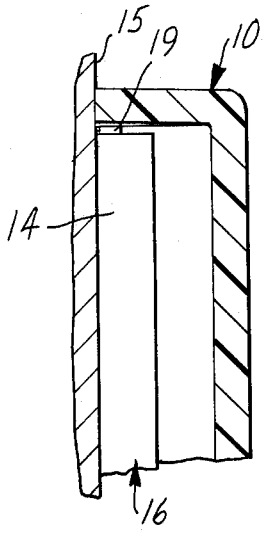
FIG. 5 is an enlarged partial section view of the cover piece of FIG. 4 attached to the air conditioner housing inside a building. The layer of flexible foam gives a frictional fit of the cover piece to the air conditioner.

FIG. 5 is an enlarged partial section view depicting the cover piece 10 flush against the wall 15 and frictionally adhering to the air conditioner housing 14 by means of the adhesively backed polyurethane flexible foam tape 19.

Through-the-wall air conditioners come in various sizes, extend to varying distances beyond either the inside or outside wall. The walls may be smooth, textured, cement, brick, stone or wood and may be placed in an odd position or angle. Yet, a cover piece, to be effective, must give a reasonably air tight insulating fit around the air conditioner. The cover must prevent the loss of energy by means of direct air currents or through loss by means of convection. The most effective covers are those custom made for the particular air conditioner. However, this is not the most cost effective manner to provide covers that prevent the loss of energy.

The kit described herein provides an economical rigid expanded polystyrene cover piece of a size slightly larger than a multiplicity of the housings for the through-the-wall air conditioner. The four adhesively backed attachment means, "Velcro" tape, double stick tape, flexible magnetic tape or flexible plastic foam tape, present alternative methods to attach securely the cover piece to the housing and proximate wall. Whichever attachment means provides the best secure fit of the air conditioner cover piece to the housing and wall is selected thereby giving an economical, effective, energy conserving cover.

What is claimed is:

1. A kit for covering an air conditioner unit mounted in a wall of a building, when said unit is not in operation, to reduce heat loss through and around said unit, said kit comprising:

(a) a rigid cover piece formed of a foamed polymeric material which is substantially impermeable to air and thermally nonconductive, having a base wall and four upstanding side walls defining an open-ended chamber having a volume greater than the volume of the portion of the air conditioner unit to be covered: and (b) an attachment means adapted for securing said cover piece in sealing engagement with said building wall or the housing of said unit comprising:

(1) a backing means which is a flexible polymeric foam selected from a group consisting of polyurethane, polyvinyl chloride and polyethylene, said backing means having a thickness between 0.3 and 2.5 cm., (2) a layer of pressure sensitive adhesive on one side of said backing means to attach said backing means to a portion of said cover piece, and (3) a securing means provided by said backing means itself which is applied to the inner surface of at least one of said side walls of said cover piece whereby said sealing engagement of said cover piece with said housing is provided by friction-fit.

2. A kit for covering an air conditioner unit mounted in a wall of a building, when said unit is not in operation, to reduce heat loss through and around said unit, said kit comprising:

(a) a rigid cover piece formed of a foamed polymeric material which is substantially impermeable to air and thermally nonconductive, having a base wall and four upstanding side walls defining an open-ended chamber having a volume greater than the volume of the portion of the air conditioner unit to be covered; and (b) an attachment means adapted for securing said cover piece in sealing engagement with said building wall or the housing of said unit comprising:

(1) a backing means which is flexible polymeric foam selected from a group consisting of polyurethane, polyvinyl chloride and polyethylene, said backing means having a thickness between 0.3 and 2.5 cm., (2) a layer of pressure sensitive adhesive on one side of said backing means to attach said backing means to a portion of said cover piece, and (3) a securing means which is a layer of pressure sensitive adhesive on the opposite side of said backing means, said securing means is to releasably adhere said cover piece to said building wall or said housing in a substantially air tight manner.

* * * * *